US009201377B2

(12) United States Patent
Miyahara et al.

(10) Patent No.: US 9,201,377 B2
(45) Date of Patent: Dec. 1, 2015

(54) IMAGE FORMING APPARATUS

(71) Applicants: Kensuke Miyahara, Nagoya (JP); Toshio Furukawa, Nagoya (JP)

(72) Inventors: Kensuke Miyahara, Nagoya (JP); Toshio Furukawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/954,103

(22) Filed: Jul. 30, 2013

(65) Prior Publication Data

US 2014/0037316 A1 Feb. 6, 2014

(30) Foreign Application Priority Data

Jul. 31, 2012 (JP) ..... 2012-169461

(51) Int. Cl.
*G03G 15/00* (2006.01)
*G03G 21/00* (2006.01)
*G03G 21/14* (2006.01)

(52) U.S. Cl.
CPC ..... *G03G 21/0005* (2013.01); *G03G 21/14* (2013.01)

(58) Field of Classification Search
CPC .... G03G 15/08; G03G 21/0005; G03G 21/14
USPC ..... 399/71
See application file for complete search history.

(56) References Cited

U.S. PATENT DOCUMENTS 4,269,503 A 5/1981 Nishikawa
5,093,688 A 3/1992 Komiya et al.
5,606,408 A 2/1997 Yano et al.
5,790,920 A * 8/1998 Teramura et al. ..... 399/71
7,539,432 B2 5/2009 Dan
2006/0245782 A1 11/2006 Hirai et al.
2006/0285873 A1 * 12/2006 Saeki ..... 399/101
2008/0008489 A1 1/2008 Watanabe et al.
2008/0031649 A1 2/2008 Dan (Continued)

FOREIGN PATENT DOCUMENTS

JP 4-67161 A 3/1992
JP 4-156559 A 5/1992

(Continued)

OTHER PUBLICATIONS

Nagata Image Forming Device Jul. 1997 JP09-190079A Japan (Machine English Translation).*

(Continued)

*Primary Examiner* — G. M. Hyder
*Assistant Examiner* — Travis Harper
(74) *Attorney, Agent, or Firm* — Banner & Witcoff, Ltd.

(57) ABSTRACT

An image forming apparatus includes: an image forming unit configured to transfer a developer image; a processor; and memory storing computer readable instructions that, when executed by the processor, causing the image forming apparatus to: perform an image forming operation of forming an image; perform a cleaning operation of cleaning unnecessary developer of the image forming unit; in a case where existence of data of an image which is to be formed is recognized after activation of the image forming apparatus before a first image forming operation, determine whether to perform the cleaning operation; and in a case where existence of data of the image which is to be formed is not recognized after the activation of the image forming apparatus before the first image forming operation, not to perform the cleaning operation.

8 Claims, 6 Drawing Sheets

(56) References Cited

U.S. PATENT DOCUMENTS

| | | | |
|---|---|---|---|
| 2008/0292330 | A1 | 11/2008 | Kabashima et al. |
| 2011/0255902 | A1 | 10/2011 | Sato et al. |
| 2012/0002996 | A1 | 1/2012 | Izumi et al. |
| 2014/0037316 | A1 | 2/2014 | Miyahara et al. |
| 2014/0119759 | A1 | 5/2014 | Yamaura et al. |

FOREIGN PATENT DOCUMENTS

| | | | | |
|---|---|---|---|---|
| JP | H08160812 | A | | 6/1996 |
| JP | 09190079 | A | * | 7/1997 |
| JP | 10-221978 | A | | 8/1998 |
| JP | 11-305624 | A | | 11/1999 |
| JP | 2004029148 | A | | 1/2004 |
| JP | 2004118095 | A | | 4/2004 |
| JP | 2006058703 | A | | 3/2006 |
| JP | 2008-039905 | A | | 2/2008 |
| JP | 4532935 | B2 | | 8/2010 |
| JP | 2012-056828 | A | | 3/2012 |
| JP | 2012247535 | A | | 12/2012 |

OTHER PUBLICATIONS

Machine Translation of JP 2012-247535.*

Co-pending U.S. Appl. No. 13/802,884, filed Mar. 14, 2013.

Nov. 6, 2014—(US) Non-Final Office Action—U.S. Appl. No. 13/802,884.

Mar. 4, 2015—(US) Notice of Allowance—U.S. Appl. No. 13/802,884.

* cited by examiner

IMAGE FORMING APPARATUS

CROSS-REFERENCE TO RELATED APPLICATIONS

This application claims priority from Japanese Patent Application No. 2012-169461 filed on Jul. 31, 2012, the entire subject matter of which is incorporated herein by reference.

TECHNICAL FIELD

Illustrative aspects of the present invention relate to an image forming apparatus configured to form an image by transferring a developer image onto a recording sheet.

BACKGROUND

As an example of an electrophotographic-type image forming apparatus such as a printer and a copy machine, there are known apparatuses configured to perform a cleaning operation of cleaning residual toner attached to some units such as a transfer belt and photosensitive drums after electric power is supplied before a first image forming operation. According to this related-art configuration, the residual toner is suppressed from being attached to a sheet, and thus it is possible to suppress a reduction in image quality.

SUMMARY

Therefore, illustrative aspects of the present invention provide an image forming apparatus capable of omitting an unnecessary cleaning operation while suppressing a reduction in image quality.

According to one illustrative aspect of the present invention, there is provided an image forming apparatus configured to transfer a developer image onto a recording sheet to form an image. The image forming apparatus comprises: an image forming unit configured to transfer the developer image; a processor; and memory. The memory is configured to store computer readable instructions that, when executed by the processor, causing the image forming apparatus to: perform an image forming operation of forming the image; perform a cleaning operation of cleaning unnecessary developer of the image forming unit; in a case where existence of data of an image which is to be formed is recognized after activation of the image forming apparatus before a first image forming operation, determine whether to perform the cleaning operation; and in a case where existence of data of the image which is to be formed is not recognized after the activation of the image forming apparatus before the first image forming operation, not to perform the cleaning operation.

DETAILED DESCRIPTION

General Overview

Figure 1:
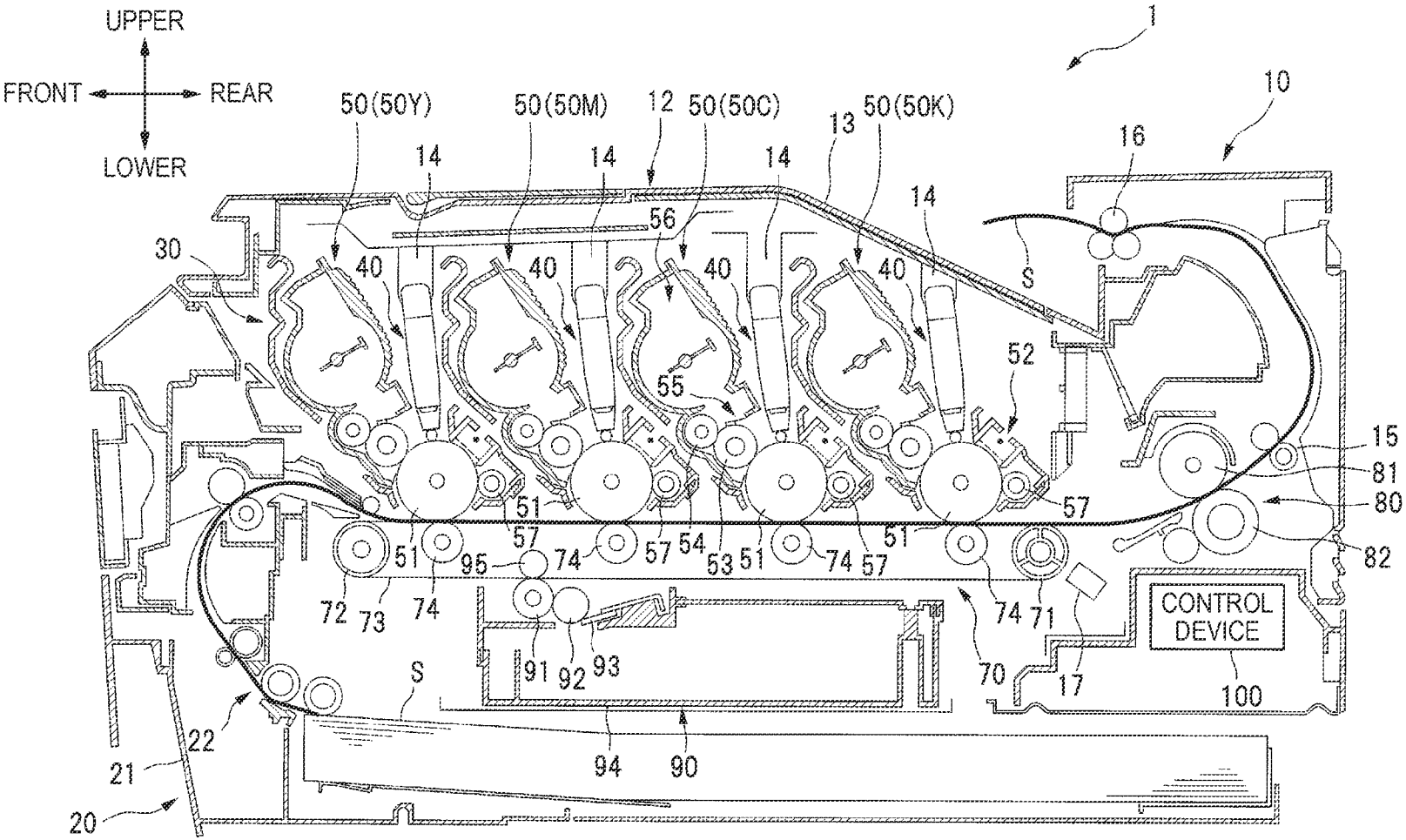
FIG. 1 is a view illustrating a schematic configuration of a color printer that is an example of an image forming apparatus according to an exemplary embodiment of the present invention.

In the above-described related art, after electric power is supplied, immediately after a cleaning operation before a first image forming operation is performed, for example, if the supply of the electric power supply is cut off due to a power failure, a malfunction, or the like, and then electric power is applied again, after the application of the electric power, even though the transfer belt, the photosensitive drums, and the like are cleaned, the cleaning operation before the first image forming operation is performed again. In other words, in the related art, an unnecessary cleaning operation may be performed.

Therefore, illustrative aspects of the present invention provide an image forming apparatus capable of omitting an unnecessary cleaning operation while suppressing a reduction in image quality.

According to a first illustrative aspect of the present invention, there is provided an image forming apparatus configured to transfer a developer image onto a recording sheet to form an image. The image forming apparatus comprises; an image forming unit configured to transfer the developer image; a processor; and memory. The memory is configured to store computer readable instructions that, when executed by the processor, causing the image forming apparatus to: perform an image forming operation of forming the image; perform a cleaning operation of cleaning unnecessary developer of the image forming unit; a case where existence of data of an image which is to be formed is recognized after activation of the image forming apparatus before a first image forming operation, determine whether to perform the cleaning operation; and in a case where existence of data of the image which is to be formed is not recognized after the activation of the image forming apparatus before the first image forming operation, not to perform the cleaning operation.

According to this configuration, in a case where there is data of any image which is to be formed after activation of the image forming apparatus before the first image forming operation, it is determined whether to perform the cleaning operation, and the cleaning operation is performed when the cleaning operation is determined to be necessary. Therefore, it is possible to suppress a reduction in image quality. On the other hand, in a case where data of any image which is to be formed after activation of the image forming apparatus before the first image forming operation does not exist, the cleaning operation is not performed. Therefore, as compared to the related art in which a cleaning operation is performed regardless of whether there is data of any image which is to be formed, it is possible to omit an unnecessary cleaning operation. Further, it is possible to reduce unnecessary operations of the image forming unit according to the cleaning operation, and thus it is possible to improve a lifetime of the apparatus.

According to a second illustrative aspect of the present invention, the image forming unit comprises an image carrier configured to carry a developer image formed thereon. The cleaning operation includes a collecting operation of collecting unnecessary developer attached to the image carrier.

According to a third illustrative aspect of the present invention, the image forming unit comprises: a plurality of image carriers; and an endless belt disposed to face the image carriers. The collecting operation includes: a first collecting operation of moving unnecessary developer attached to the image carriers onto the belt; and a second collecting operation of collecting the unnecessary developer attached to the belt.

According to a fourth illustrative aspect of the present invention, the image forming unit comprises a holding member configured to hold the unnecessary developer attached to the image carrier and to move the held developer onto the image carrier. The cleaning operation includes a moving operation of moving the developer held by the holding member onto the image carrier. The processor is configured to cause the image forming apparatus to: perform the moving operation and the collecting operation after the image forming operation terminates; set a flag when a predetermined time period elapses from start of the moving operation; unset the flag when the image forming operation starts. In the case where the existence of data of the image which is to be formed is recognized after the activation of the image forming apparatus before the first image forming operation, the processor is configured to cause the image forming apparatus to: if the flag is not set, perform the moving operation and the collecting operation; and if the flag is set, omit performance of at least the moving operation.

According to this configuration, even in the case of recognizing existence of data of an image which is to be formed, if the flag is not set, the moving operation and the collecting operation are performed before the first image forming operation. Therefore, it is possible to suppress a reduction in image quality. On the other hand, in the case where the flag is set, performance of at least the moving operation is omitted before the first image forming operation. Therefore, it is possible to reduce the time of the cleaning operation. According thereto, it is possible to improve the lifetime of the apparatus and to reduce a time for the apparatus to become capable of image forming.

According to a fifth illustrative aspect of the present invention, the image forming operation includes: a monochrome image forming operation of forming a monochrome image on the recording sheet; and a color image forming operation of forming a color image on the recording sheet. In the case where the existence of data of the image which is to be formed is recognized after the activation of the image forming apparatus before the first image forming operation, the processor is configured to cause the image forming apparatus to: if the recognized data is monochrome image data, perform the moving operation and the collecting operation; and if the recognized data is color image data, omit performance of at least the moving operation and the first collecting operation.

According to this configuration, even in the case of recognizing existence of data of an image which is to be formed, if the recognized data is color image data, performance of at least the moving operation and the first collecting operation is omitted. Therefore, it is possible to reduce the time of the cleaning operation.

According to a sixth illustrative aspect of the present invention, the image forming operation includes a patch image forming operation of forming a patch image on the belt. In the case where the existence of data of the image which is to be formed is recognized after the activation of the image forming apparatus before the first image forming operation, the processor is configured to cause the image forming apparatus to: if the recognized data is patch image data, perform at least the second collecting operation.

According to this configuration, before the image forming operation, specifically, before the patch image is formed on the belt, it is possible to perform the second collecting operation, thereby collecting unnecessary developer attached to the belt. Therefore, it is possible to form the patch image on the clean belt. As a result, it becomes possible to improve accuracy of misalignment correction, concentration correction, and the like according to patch detection.

According to a seventh illustrative aspect of the present invention, the image forming unit comprises a plurality of image carriers. The image forming operation includes: a monochrome image forming operation of forming a monochrome image on the recording sheet; and a color image forming operation of forming a color image on the recording sheet. In the case where the existence of data of the image which is to be formed is recognized after the activation of the image forming apparatus before the first image forming operation, the processor is configured to cause the image forming apparatus to: if the recognized data is monochrome image data, perform the moving operation and the collecting operation; and if the recognized data is color image data, omit performance of at least the moving operation.

According to this configuration, even in the case of recognizing existence of data of an image which is to be formed, if the recognized data is color image data, performance of at least of the moving operation is omitted. Therefore, it is possible to reduce the time of the cleaning operation.

According to an eighth illustrative aspect of the present invention, the processor is configured to cause the image forming apparatus to: set a first flag when a first time period elapses from the start of the moving operation; set a second flag when a second time period elapses from a start of the first collecting operation; set a third flag when a third time period elapses from a start of the second collecting operation; and unset the first flag, the second flag and the third flag when the image forming operation starts. In the case where the existence of data of the image which is to be formed is recognized after the activation of the image forming apparatus before the first image forming operation, the processor is configured to cause the image forming apparatus to: if the first flag is not set, perform the moving operation, the first collecting operation and the second collecting operation; if the first flag is set and the second flag is not set, perform the first collecting operation and the second collecting operation while omitting performance of the moving operation; and if the first flag is set and the second flag is set, perform the second collecting operation while omitting performance of the moving operation and the first collecting operation.

According to the illustrative aspects of the present invention, it is possible to omit unnecessary cleaning operations while suppressing a reduction in image quality.

Exemplary Embodiments

First Exemplary Embodiment

Hereinafter, a first exemplary embodiment of the present invention will be described in detail with reference to appropriate drawings. In the following description, directions of a color printer 1 that is one example of the image forming apparatus refer to the directions as seen from a user facing to the color printer during its use. To be more specific, referring to FIG. 1, a left-side direction and a right-side direction of the drawing sheet are referred to as a "front side" and a "rear side"

of the color printer, respectively. Incidentally, a direction toward the viewer of FIG. 1 as a "right side", and a direction away from a viewer of FIG. 1 is referred to as a "left side". An upward and downward direction in FIG. 1 is referred to as a "vertical direction" or an "upward and downward direction" as it is.

(Schematic Configuration of Color Printer)

As shown in FIG. 1, a color printer 1 includes a sheet feeding unit 20, an image forming unit 30 and a collecting unit 90 inside a main body case 10. On the upper side of the main body case 10, an upper cover 12 is configured to be able to be raised or lowered with its rear side as a rotation center such that the upper cover is opened or closed.

The sheet feeding unit 20 is provided at the lower portion of the inside of the main body case 10. The sheet feeding unit 20 includes a sheet feeding tray 21, which is configured to store the sheet S that is one example of a recording sheet, and a feeding mechanism 22 configured to feed the sheet S from the sheet feeding tray 21 to the image forming unit 30. The sheet S stored in the sheet feeding tray 21 are fed one at a time to the image forming unit 30 by the feeding mechanism 22.

The image forming unit 30 includes four LED units 40, four process units 50, a transfer unit 70 and a fixing unit 80, for example.

The LED units 40 are disposed to face the upper sides of photosensitive drums 51. Each of the LED units 40 include a plurality of LEDs (light emitting diodes) (not shown) arranged in a left-right direction at the lower end thereof. The LEDs of the LED units 40 are configured to turn on and off on the basis of image data to expose the surfaces of the photosensitive drums 51. Further, the LED units 40 are held in the upper cover 12 by holding units 14 and are spaced away from the photosensitive drums 51 by opening the upper cover 12.

The plurality of process units 50 is arranged side by side between the upper cover 12 and the sheet feeding tray 21. The plurality of process units 50 is configured to be detachably installed into the main body case 10 in a state where the upper cover 12 is open. The process units 50 each include a photosensitive drum 51 that is one example of an image carrier, a charger 52, a developing roller 53, a feeding roller 54, a layer-thickness regulating blade 55, a toner container 56 configured to contain positive charge type toner that is one example of developer, and a holding roller 57 that is one example of a holding member and are for yellow, magenta, cyan and black toner, respectively. The process units 50 for yellow, magenta, cyan and black toner are denoted by reference symbols 50Y, 50M, 50C and 50K, respectively, and are arranged sequentially from the front. The holding rollers 57 are configured to temporarily hold unnecessary toner attached to the photosensitive drums 51. Also, the holding rollers 57 are configured to more the held toner onto the photosensitive drums 51.

The transfer unit 70 is provided between the sheet feeding unit 20 and the process units 50. The transfer unit 70 includes a driving roller 71, a driven roller 72, a conveyance belt 73, which is one example of an endless belt, and four transfer rollers 74. The conveyance belt 73 is stretched between the driving roller 71 and the driven roller 72 such that the outer surface of the conveyance belt faces the individual photosensitive drums 51. Inside the conveyance belt, the transfer rollers 71 are disposed to face corresponding photosensitive drums 51 with the conveyance belt 73 interposed therebetween.

The fixing unit 80 is provided behind the process units 50 and the transfer unit 70. The fixing unit 80 includes a heating roller 81 and a pressing roller 82 that is disposed to face the heating roller 81 and is configured to press the heating roller 81.

The collecting unit 90 is below the conveyance belt 73. The collecting unit 90 includes a first collecting roller 91, a second collecting roller 92, a scraping blade 93, a toner accumulating unit 94 and a backup roller 95. The backup roller 95 is disposed with the conveyance belt 73 interposed between the backup roller 95 and the first collecting roller 91.

(Outline of Operation of Color Printer)

Subsequently, outlines of operations which are performed by the color printer 1, specifically, an image forming operation, a holding operation and a cleaning operation will be described.

The image forming operation is an operation of transferring a toner image (developer image) onto a sheet S to form an image. The color printer 1 is configured to perform a monochrome image forming operation of forming a monochrome image on the sheet S, a color image forming operation of forming a color image on the sheet S and a patch image forming operation of forming a patch image on the conveyance belt 73, as the image forming operation.

In the image forming operation, as a common operation, the surfaces of the photosensitive drums 51 rotating are uniformly charged with positive electric charge by the chargers 52, and then are exposed by the LED units 40, whereby electrostatic latent images based on image data are formed on the photosensitive drums 51. Further, at this time, the toner stored in the toner containers 56 is fed onto the developing rollers 53 through the feeding rollers 54, and enters between the developing rollers 53 and the layer-thickness regulating blades 55 such that the toner is carried as a thin layer with a constant thickness on the developing rollers 53. Then, the toner carried on the developing rollers 53 is fed onto the photosensitive drums 51, whereby the electrostatic latent images turn into visible images, that is, toner images are formed on the photosensitive drums 51.

During the monochrome image forming operation, a toner image is formed only on the photosensitive drum 51 of the process unit 50K for black. Further, during the color image forming operation, toner images are formed on the photosensitive drums 51 of the four process units 50. Then, a sheet S fed from the sheet feeding unit 20 is conveyed between the photosensitive drums 51 and the conveyance belt 73 (the transfer rollers 74 with an applied negative transfer bias), whereby the toner images on the photosensitive drums 51 are transferred onto the sheet S. Thereafter, the sheet S is conveyed between the heating roller 81 and the pressing roller 82 such that the toner image is thermally fixed. In this way, an image is formed on the sheet S. The sheet S with the image formed thereon is discharged from the inside of the main body case 10 onto a paper discharge tray 13 by a conveying roller 15 and a discharging roller 16.

During the patch image forming operation, any sheet S is not fed from the sheet feeding unit 20, and toner images formed on the photosensitive drums 51 are transferred directly onto the conveyance belt 73. The toner image transferred on the conveyance belt 73 is detected by a patch detecting sensor 17 disposed to face the rear portion of the conveyance belt 73. In the color printer 1, on the basis of the detection result of the patch detecting sensor 17, misalignment correction, concentration correction, and the like are performed by known methods.

The holding operation is an operation of holding residual toner, which has not been transferred onto the photosensitive drum 51, on the holding rollers 57, in other words, an operation of intermittently cleaning the photosensitive drums 51.

The holding operation can be performed, for example, in the middle of the image forming operation or the like. Specifically, in the holding operation, holding biases, which are positive or negative biases smaller than the surface potentials of the photosensitive drums 51, are applied to the holding rollers 57, and in this state, the holding rollers 57 and the photosensitive drums 51 are rotated. As a result, the toner on the photosensitive drums 51 moves onto and is held on the holding rollers 57.

The cleaning operation is an operation of cleaning unnecessary toner attached to the image forming unit 30, specifically, the photosensitive drums 51, the holding rollers 57, the conveyance belt 73, and so on. As the cleaning operation, the color printer 1 is configured to perform a moving operation and a collecting operation, which will be described later.

The moving operation is an operation of moving toner held by the holding rollers 57 onto the photosensitive drums 51, in other words, an operation of cleaning the holding rollers 57. The moving operation can be performed, for example, after the image forming operation terminates. Specifically, in the moving operation, discharge biases which are positive biases larger than the surface potentials of the photosensitive drums 51 are applied to the holding rollers 57, and in this state, the holding rollers 57 and the photosensitive drums 51 are rotated. As a result, the toner held by the holding rollers 57 moves onto the photosensitive drums 51.

The collecting operation is an operation of controlling the collecting unit 90 to collect unnecessary toner attached to the photosensitive drums 51 and the conveyance belt 73, in other words, an operation of cleaning the photosensitive drums 51 and the conveyance belt 73. The collecting operation can be performed, for example, after the image forming operation terminates. The color printer 1 of the present exemplary embodiment is configured to perform a first collecting operation of moving the toner held on the photosensitive drums 51 onto the conveyance belt 73, and a second collecting operation of controlling the collecting unit 90 to collect the toner held on the conveyance belt 73, as the collecting operation. In the first collecting operation, negative biases are applied to the transfer rollers 74, and in this state, the photosensitive drums 51, the conveyance belt 73, and the like are rotated. As a result, the toner on the photosensitive drums 51 moves onto the conveyance belt 73. Further, in the second collecting operation, a bias is applied between the first collecting roller 91 and the backup roller 95, and in this state, the conveyance belt 73, the first collecting roller 91, and the like are rotated. As a result, the toner on the conveyance belt 73 moves onto the second collecting roller 92 through the first collecting roller 91, and is scraped by the scraping blade 93, thereby being collected into the toner accumulating unit 94.

(Detailed Configuration of Color Printer)

The color printer 1 further includes a control device 100, in addition to the plurality of photosensitive drums 51, the holding rollers 57, the transfer unit 70 and the collecting unit 90.

The control device 100 is a device configured to control the operation of the color printer 1. The control device 100 is disposed at an appropriate position inside the main body case 10. The control device 100 is configured by including a central processing unit (CPU), a, random access memory (RAM), a read only memory (ROM), an input/output interface, and so on (not shown). The control device 100 is configured to perform control by performing each computational process on the basis of detection results of various sensors, predetermined programs, and so on.

Specifically, in a case of recognizing that data of any image which is to be formed (hereinafter, referred to as "image data") is on a memory (not shown) of the color printer 1 after activation of the color printer 1 before a first image forming operation, the control device 100 determines whether to perform the cleaning operation in first to fourth patterns (to be described below). After the determination, according to the determination result, the control device 100 performs the cleaning operation or the image forming operation. On the other hand, in a case where the control device 100 does not recognize existence on any image data on the memory after activation of the color printer 1 before a first image forming operation, the control device 100 does not perform the cleaning operation, and makes the color printer 1 a standby state until recognizing existence of any image data. In the following description, control after activation of the color printer 1 before a first image forming operation will be referred to as control during activation.

Here, activation of the color printer 1 means, for example, a case where the color printer 1 is powered on, or a case where a sensor (not shown) detects the upper cover 12 in an open state has been closed, or the like. Further, the case of 'recognizing existence of image data after activation of the color printer 1 before a first image forming operation' means: a case of recognizing image data existing on the memory at the time of activation; a case of recognizing image data input to the memory after activation of the color printer 1 before a first image forming operation even though there was no image data on the memory at the time of the activation; or the like.

After performing the control during activation, the control device 100 performs the following basic control. That is, when a job including an image forming instruction is input, the control device 100 performs an image forming operation on the basis of image data on the memory, and performs the holding operation in the middle of the image forming operation. Here, image data on the memory is: monochrome or color image data that has been input together with a job to the color printer 1 and is to be formed on the sheets S; image data of a patch, which has been stored in a storage unit (not shown) of the color printer 1, which has been read from the storage unit as necessary, and which has been developed on the memory; or the like.

Further, after an image forming operation terminates, for example, in a case where a sheet sensor (not shown) detects that the last one of sheets S with images formed thereon has been discharged from the inside of the main body case 10, or after correction based on a patch image terminates, or the like, the control device 100 performs the cleaning operation, specifically, the moving operation and the collecting operation (the first collecting operation and the second collecting operation).

Further, in the case of recognizing existence of any image data after activation of the color printer 1 before a first image forming operation, if the image data recognized from the memory is the patch image data, the control device 100 necessarily performs the second collecting operation.

Hereinafter, the basic control and the control during activation in the color printer 1 according to the present exemplary embodiment will be described in detail with reference to a flow chart and time charts.

(Basic Control of Color Printer)

Figure 2:
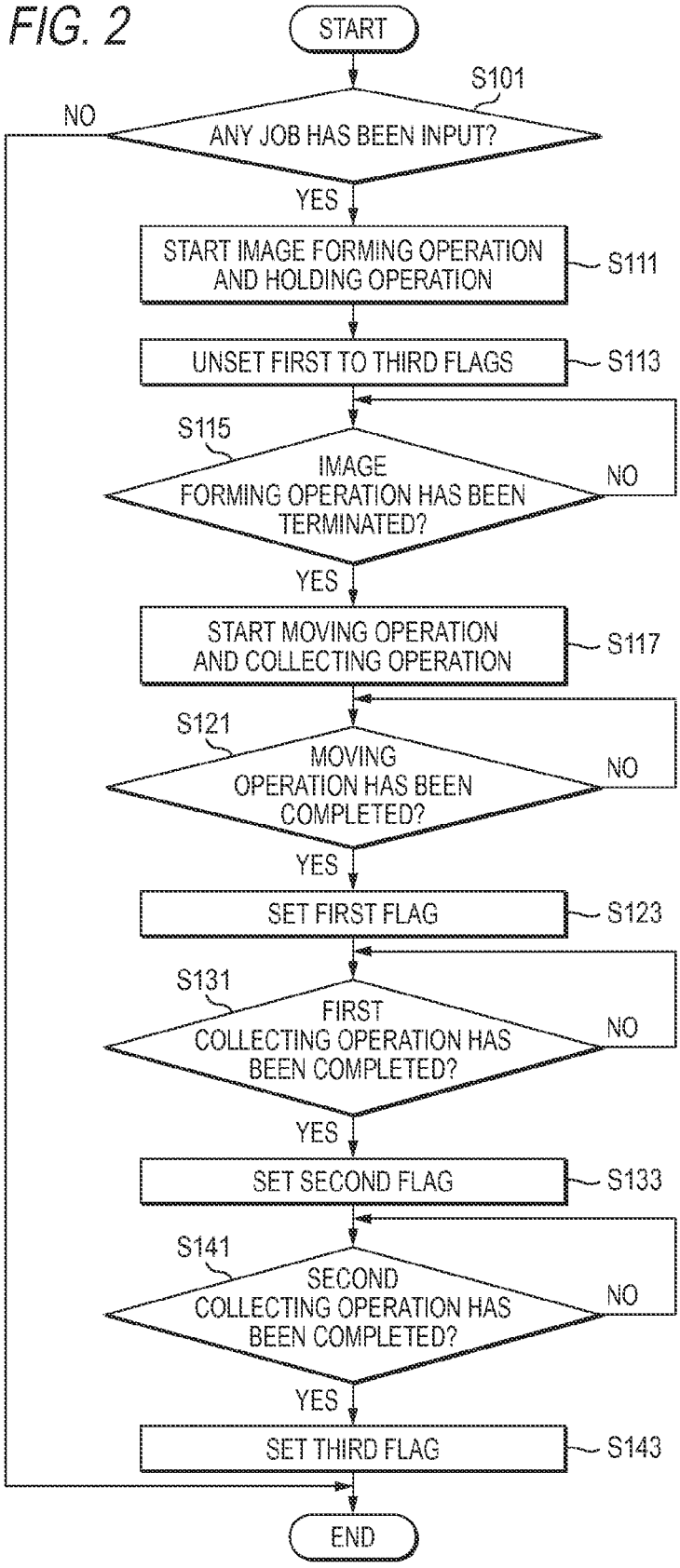
FIG. 2 is a flow chart illustrating basic control of the color printer.

The control device 100 repeatedly performs processes of a flow chart shown in FIG. 2, as the basic control.

More specifically, when a job is input (Yes in STEP S101), in STEP S111, the control device 100 starts an image forming operation and a holding operation. Further, during the start of the image forming operation, in STEP S113, the control device 100 unsets first to third flags. The timing when the first to third flags are unset is not limited only to the time when an image forming operation starts, but may be set to the time when a job is input before start of an image forming operation, or immediately after start of an image forming operation, or the like.

Figure 3A:
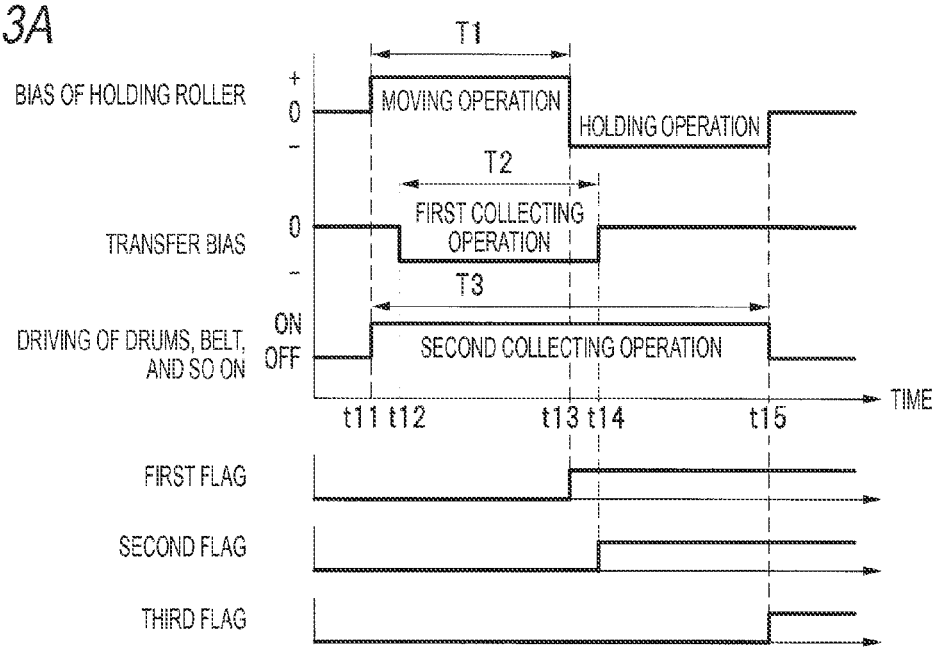
FIGS. 3A to 3C are time charts illustrating control of the color printer.

When the image forming operation terminates (Yes in STEP S115), in STEP S117, the control device 100 terminates the holding operation and starts a moving operation and a collecting operation. Specifically, as shown in FIG. 3A, after the termination of the image forming operation, the control device 100 starts a moving operation, a first collecting operation and a second collecting operation at times t11 and t12. Incidentally, in FIG. 3A, the first collecting operation starts (at the time t12) later than the moving operation and the second collecting operation; however, the first collecting operation may start at the same time (the time t11) with the moving operation and the second collecting operation.

When a first time T1, which is one example of a predetermined time, elapses from the start of the moving operation, the control device 100 terminates (completes) the moving operation. Here, the first time T1 is, for example, a predetermined time when the holding rollers 57 can rotate several times. When the moving operation is completed (Yes in STEP S121), in STEP S123, the control device 100 sets the first flag, which is one example of a flag, at a time t13. Incidentally, in FIG. 3A, the holding operation is performed from the time of completion of the moving operation to the time of completion of the second collecting operation (see from the time t13 to a time US); however, whether to perform a holding operation after completion of a moving operation is arbitrary.

Further, when a second time T2 elapses from the start of the first collecting operation (the time t12), the control device 100 completes the first collecting operation. Here, the second time T2 is, for example, a predetermined time when the photosensitive drums 51 can rotate several times. When the first collecting operation is completed (Yes in STEP S131), in STEP S133, the control device 100 sets the second flag at a time t14.

Further, when a third time T3 elapses from the start of the second collecting operation, the control device 100 completes the second collecting operation. Here, the third time T3 is, for example, a predetermined time considered to be taken to collect most of toner on the conveyance belt 73 by the collecting unit 90. When the second collecting operation is completed (Yes in STEP S141), in STEP S143, the control device 100 sets the third flag at the time t15 and terminates the process of the flow chart shown in FIG. 2.

(Control During Activation of Color Printer)

Subsequently, the control during activation of the color printer 1 will be described.

First, determination on whether to perform a cleaning operation which is performed in a case of recognizing existence of any image data on the memory after activation of the color printer 1 before a first image forming operation, and control (1) to (4) which is performed after the determination will be described.

(1) In a case where the first flag is not set when existence of image data is recognized, prior to performance of the first image forming operation, the control device 100 performs the cleaning operation, specifically, all of the moving operation, the first collecting operation and the second collecting operation. Specifically, as shown in FIG. 3A, the control device 100 starts the moving operation, the first collecting operation and the second collecting operation (at the times t11 and t12). When the first time T1 elapses (at the time 13), the control device 100 completes the moving operation. When the second time T2 elapses (at the time 14), the control device 100 completes the first collecting operation. When the third time T3 elapses (at the time 15), the control device 100 completes the second collecting operation. In other words, in the case where the first flag is not set, the control device 100 performs the same control as that after termination of an image forming operation.

(2) In a case where the first flag is set when existence of any image data is recognized, prior to a first image forming operation, the control device 100 performs the cleaning operation while omitting the moving operation. This is because in the case where the first flag is set, since the moving operation has been already completed, the holding rollers 57 are cleaned. In this case, if there is an opening-closing history of the upper cover 12, or if the second flag is not set, the control device 100 performs the first collecting operation and the second collecting operation as the cleaning operation while omitting the moving operation. Besides, the control device 100 performs the holding operation.

Figure 3B:
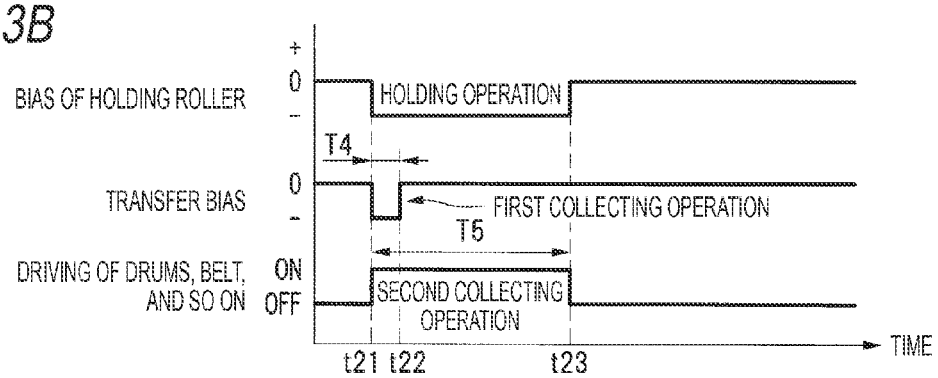

Specifically, as shown in FIG. 3B, the control device 100 starts the first collecting operation, the second collecting operation and the holding operation at a time t21. Then, when a fourth time T4 elapses from the start of the first collecting operation, the control device 100 completes the first collecting operation at a time t22. Here, the fourth time T4 is, for example, a predetermined time when the photosensitive drums 51 can rotate once, Next, when a fifth time T5 elapses from the start of the second collecting operation, the control device 100 completes the second collecting operation and the holding operation at a time t23. Here, the fifth time T5 is, for example, a predetermined time considered to be taken to collect most of toner on the conveyance belt 73 by the collecting unit 90.

Incidentally, the opening-closing history of the upper cover 12 is information indicating that the upper cover 12 in a closed state has been opened and then closed again. For example, this opening-closing history may be obtained on the basis of an input from an opening-closing sensor for detecting opening and closing of the upper cover 12, or may be obtained by using a known component capable of mechanically leaving the opening-closing history of the upper cover 12 and detecting the state of the corresponding component with a sensor or the like. According to the latter configuration, even if the upper cover 12 is opened and closed when the color printer is off, it is possible to obtain the opening-closing history.

(3) In a case where the first and second flags are set when existence of any image data is recognized, prior to the first image forming operation, the control device 100 performs the cleaning operation while omitting the moving operation and the first collecting operation. This is because in the case where the first and second flags are set, since the moving operation and the first collecting operation have been already completed before the activation of the color printer 1, the holding rollers 57 and the photosensitive drums 51 are cleaned. In this case, if the third flag is not set, the control device 100 performs only the second collecting operation as the cleaning operation while omitting the moving operation and the first collecting operation. Besides, the control device 100 performs the holding operation in addition to performing the second collecting operation.

Figure 3C:
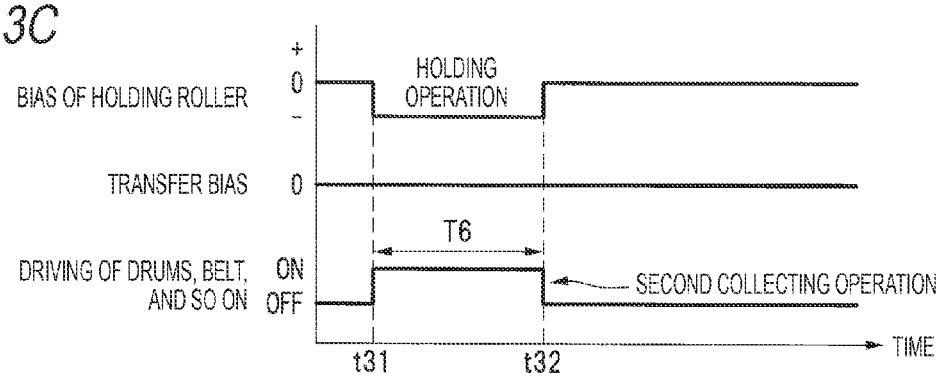

Specifically, as shown in FIG. 3C, the control device 100 starts the second collecting operation and the holding operation at a time t31. Then, when a predetermined sixth time T6 which is, for example, a time considered to be taken to collect most of toner on the conveyance belt 73 by the collecting unit 90 elapses from the start of the second collecting operation, the control device 100 completes the second collecting operation and the holding operation at a time t32. Incidentally, in the case of performing only the second collecting operation, since movement of toner from the photosensitive drums 51 to the conveyance belt 73 is suppressed, any transfer bias is not applied to the transfer rollers 74.

(4) In a case where all of the first to third flags are set when existence of any image data is recognized, prior to a first image forming operation, the control device 100 does not perform the cleaning operation. This is because in the case where the first to third flags are set, since all of the moving operation, the first collecting operation and the second collecting operation have been already completed, all of the holding rollers 57, the photosensitive drums 51 and the conveyance belt 73 are cleaned.

Incidentally, in the present exemplary embodiment, in a case where image data is patch image data, even if all of the first to third flags are set, prior to a first image forming operation, specifically, prior to formation of a patch image on the conveyance belt 73 and performance of subsequent correction based on the formed patch, the control device 100 performs the second collecting operation. Therefore, it is possible to further reduce toner on the conveyance belt 73 prior to formation of the patch image on the conveyance belt 73, and it is possible to form the patch image on the clean conveyance belt 73. As a result, it is possible to improve accuracy of correction based on detection of the patch image.

Figure 5:
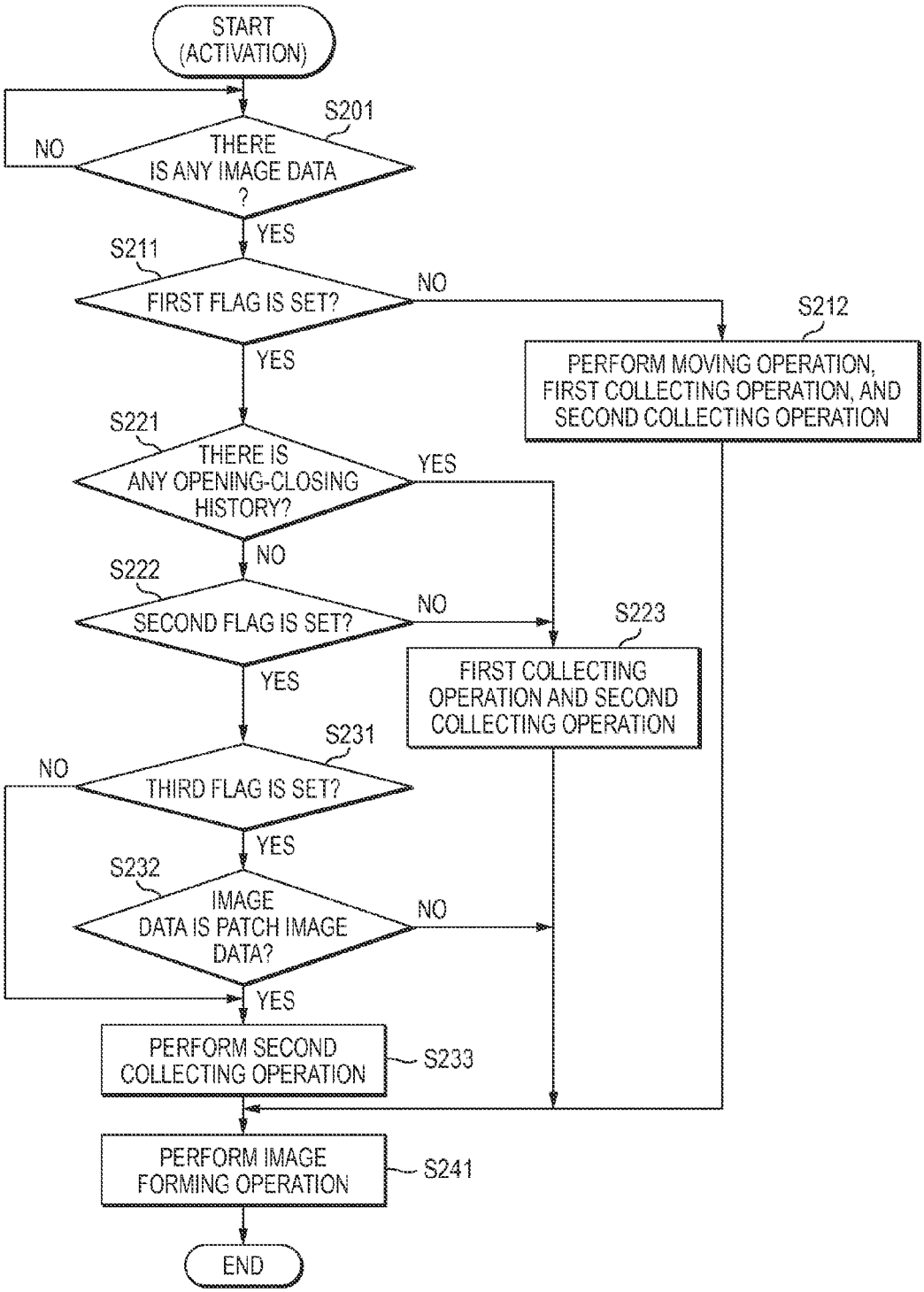
FIG. 5 is a flow chart illustrating control during activation of the color printer according to a first exemplary embodiment.

Subsequently, the control during activation will be described in more detail with reference to time charts shown in FIGS. 1A to 1E and a flow chart shown in FIG. 5.

Figure 4A:
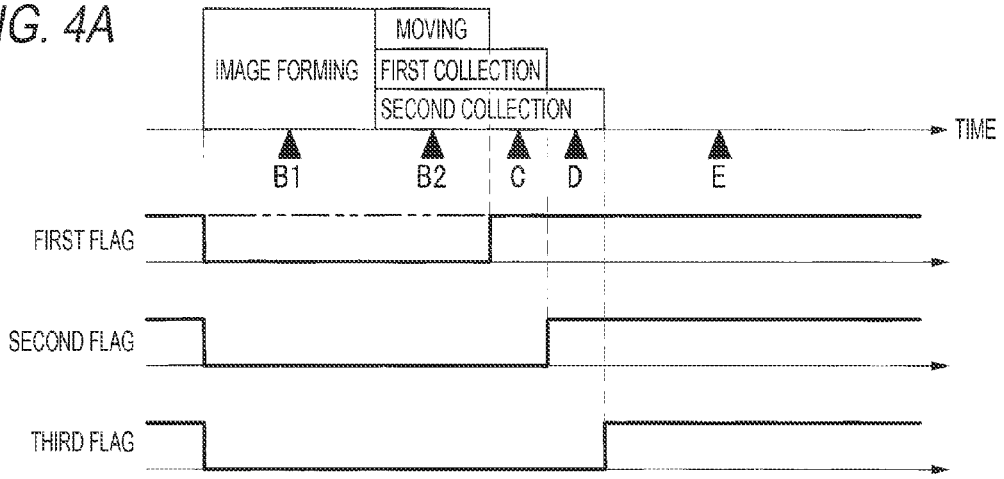
FIGS. 4A to 4E are time charts for explaining control during activation of the color printer.
Figure 4B:
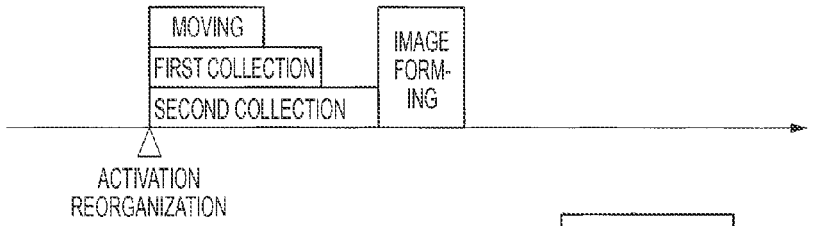

As shown as a time point B1 of FIG. 4A, for example, in a case where a sheet is jammed in the middle of the image forming operation and the user opens the upper cover 12, removes the jammed sheet and closes the upper cover 12, the color printer 1 is activated as shown in FIG. 4B. In this case, at the time of the activation, the image forming operation has not been completed, and thus there is image data on the memory. For this reason, as shown in FIG. 5, the control device 100 recognizes existence of the image data (Yes in STEP S201) and performs processes of STEP S211 and subsequent steps.

At the time point B1 of FIG. 4A, the first flag is not set (No in STEP S211). Therefore, in STEP S212, similar to the case where the image forming operation has terminated, as shown in FIG. 4B, the control device 100 performs the cleaning operation, specifically, all of the moving operation, the first collecting operation and the second collecting operation. Then, when all of the moving operation, the first collecting operation, and the second collecting operation are completed, in STEP S241, the control device 100 restarts the image forming operation interrupted by the occurrence of the jam. When the image forming terminates, the control device 100 terminates the control after the activation, and performs the basic control (see FIG. 2).

Figure 4C:
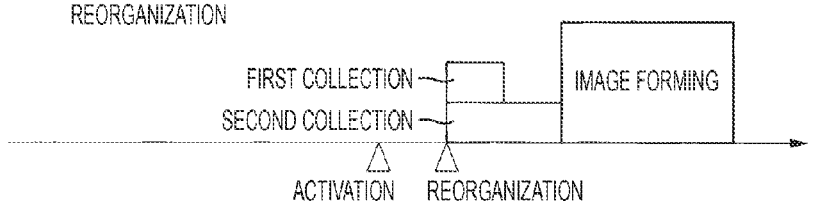
Figure 4D:
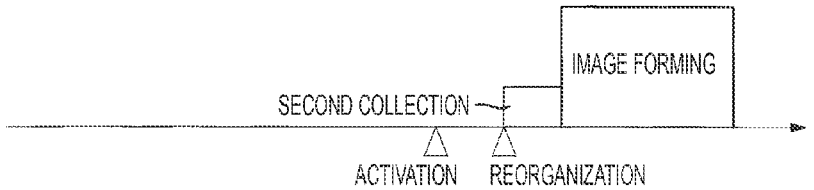
Figure 4E:
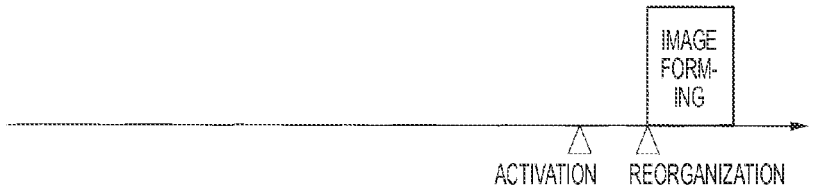

On the other hand, in a case where the image forming operation and the subsequent cleaning operation (the basic control) have terminated normally and thus the color printer 1 is in a standby state as shown by a time point E of FIG. 4A, for example, if the color printer is powered off and is then powered on again, the color printer 1 is activated as shown in FIG. 4E. In this case, at the time of the activation, since there is no image data on the memory, the control device 100 does not recognize existence of any image data (No in STEP S201) and thus repeats the determination of STEP S201 without performing the cleaning operation, as shown in FIG. 5.

When a job is input, since image data is input to the memory, the control device 100 recognize existence of the image data (Yes in STEP S201), and performs the processes of STEP S211 and subsequent steps. At the time point E, the first flag is set (Yes in STEP S211), and since the color printer has been activated by being turned off and then turned on, there is no opening-closing history of the upper cover 12 (No in STEP S221). Further, the second flag is set (Yes in STEP S222) and the third flag is set (Yes in STEP S231). Therefore, the control device 100 performs processes of STEP S232 and subsequent steps.

Then, in a case where the image data is data of an image which is to be formed on a sheet S (No in STEP S232), in STEP S241, the control device 100 performs the image forming operation on a sheet S. On the other hand, in a case where the image data is data of a patch image (Yes in STEP S232), the control device 100 performs the second collecting operation for improving accuracy of correction in STEP S233, and then performs formation of the patch image on the conveyance belt 73 and correction in STEP S241. When those operations terminate, the control device 100 terminates the control during activation, and performs the basic control.

In the middle of the moving operation (a time point 132 of FIG. 4A), or from the time of completion of the moving operation to the time of completion of the first collecting operation (a time point C), or from the time of completion of the first collecting operation to the time of completion of the second collecting operation (a time point D), even if the color printer 1 is activated, there is no image data on the memory. Thus, the control device 100 does not recognize existence of any image data and thus does not perform the cleaning operation (No in STEP S201), as shown in FIG. 5. Then, when a job is input, the control device 100 recognizes existence of image data (Yes in STEP S201), and performs the processes of STEP S211 and subsequent steps.

Here, at the time point 132 of FIG. 4A, since the first flag is not set (No in STEP S211), in STEP S212, as shown in FIG. 4B, the control device 100 performs all of the moving operation, the first collecting operation and the second collecting operation. Then, when all of the moving operation, the first collecting operation and the second collecting operation are completed, the control device 100 performs the image forming operation in STEP S241. When this operation terminates, the control device 100 terminates the control during activation and performs the basic control.

Further, at the time point C of FIG. 4A, since the first flag is set (Yes in STEP S211), the control device 100 performs the processes of STEP S221 and subsequent steps. If the activation is based on opening and closing of the upper cover 12, since an opening-closing history exists (Yes in STEP S221), in STEP S223, the control device 100 performs the first collecting operation and the second collecting operation as shown in FIG. 4C. Then, when the first collecting operation and the second collecting operation are completed, in STEP S241, the control device 100 performs the image forming operation. When the image forming operation terminates, the control device 100 terminates the control during activation, and performs the basic control, if the activation is based on the turning off and on of the power, since there is no opening-closing history (No in STEP S221), and the second flag is not set at the time point C (No in STEP S222), the control device 100 performs the processes of STEP S223 and subsequent steps as described above.

Further, at the time point D of FIG. 4A, if the activation is based on turning off and on of the power, the first flag is set (Yes in STEP S211), any opening-closing history does not exist (No in STEP S221), and the second flag is set (Yes in STEP S222). Therefore, the control device 100 performs the processes of STEP S231 and subsequent steps. At the time point D, since the third flag is not set (No in STEP S231), in STEP S233, the control device 100 performs only the second collecting operation as shown in FIG. 4D. When the second collecting operation is completed, in STEP S241, the control device 100 performs the image forming operation. When this operation terminates, the control device 100 terminates the control after activation and performs the basic control.

Incidentally, in a case where there is any opening-closing history of the upper cover 12 (Yes in STEP S221), the control device 100 performs both of the first collecting operation and the second collecting operation, regardless of the states of the second flag and the third flag. The reason is as follows: In a case where the upper cover 12 is opened, for example, there is a possibility that the user might touch the photosensitive drums 51 or the conveyance belt 73 with hands stained with toner such that the toner is attached to the photosensitive drums 51 or the conveyance belt 73, and thus it is necessary to collect the attached toner. Thus, by performing both of the first collecting operation and the second collecting operation, it is possible to suppress a sheet S from being stained with toner attached to the photosensitive drums 51 and the like in the open state of the upper cover 12, and thus it is possible to suppress a reduction in image quality.

According to the color printer 1 of the present exemplary embodiment described above, in a case where image data exists after activation before a first image forming operation, determination on whether to perform the cleaning operation is performed, and the cleaning operation is performed if it is determined to be necessary. Therefore, it is possible to suppress a reduction in image quality. On the other hand, in a case where there is no image data after activation before a first image forming operation, since the cleaning operation is not performed, as compared to a configuration where the cleaning operation is performed regardless of existence or non-existence of image data, it is possible to omit an unnecessary cleaning operation. Therefore, it is possible to reduce unnecessary operations of the photosensitive drums 51, the conveyance belt 73, and the like according to the cleaning operation, and thus it becomes possible to improve the lifetime of the color printer 1.

Further, in the case where the first flag is not set after activation before a first image forming operation, as shown in FIG. 4B and the like, all of the moving operation, the first collecting operation and the second collecting operation are performed prior to the first image forming operation. Therefore, it is possible to clean the holding rollers 57, the photosensitive drums 51 and the conveyance belt 73, and it is possible to suppress a reduction in image quality.

On the other hand, in the case where the first flag is set after activation before a first image forming operation, as shown in FIG. 4C, before the first image forming operation, the moving operation which is part of the cleaning operation is omitted. Therefore, it is possible to reduce the time of the cleaning operation. Similarly, in the case where the second flag is set after activation before a first image forming operation, as shown in FIG. 4D, before the first image forming operation, the moving operation and the first collecting operation which are part of the cleaning operation are omitted. Therefore, it is possible to reduce the time of the cleaning operation. As a result, it becomes possible to improve the lifetime of the color printer 1, and it is possible to reduce a time for the color printer 1 to become capable of image forming.

Further, in the case where the third flag is set after activation before a first image forming operation, as shown in FIG. 4E, before the first image forming operation, the cleaning operation is not performed. Therefore, it is possible to omit an unnecessary cleaning operation, and it becomes possible to improve the lifetime of the color printer 1. Further, it is possible to further reduce the time for the color printer 1 to become capable of image forming.

Second Exemplary Embodiment

Subsequently, a second exemplary embodiment of the present invention will be described. The present exemplary embodiment is different from the above-described first exemplary embodiment mainly in control in a case of recognizing existence of image data after activation of the color printer 1 before a first image forming operation. Therefore, components identical to those of the first exemplary-embodiment are denoted by the same reference symbols, and will be omitted. Further, in the following description, photosensitive drums 51, developing rollers 53, and the like corresponding to toner colors are specified, and thus in this specification and the drawings, Y, M, C and K are attached corresponding to yellow magenta, cyan and black.

Figure 6A:
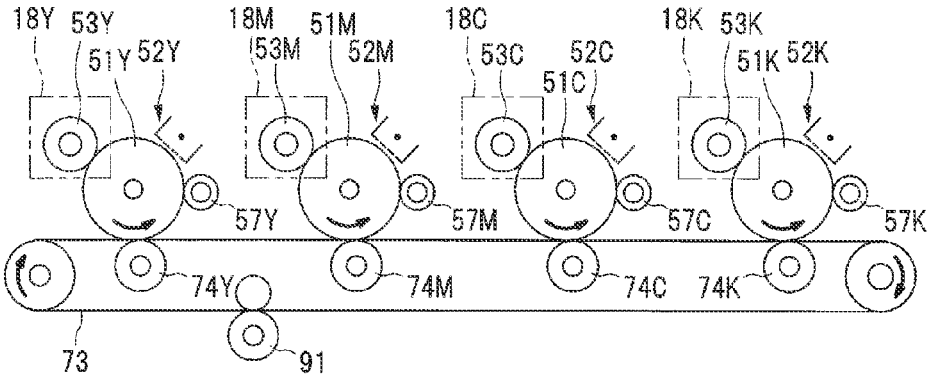
FIG. 6A is a view illustrating a state where all developing rollers are in contact with corresponding photosensitive drums.
Figure 6B:
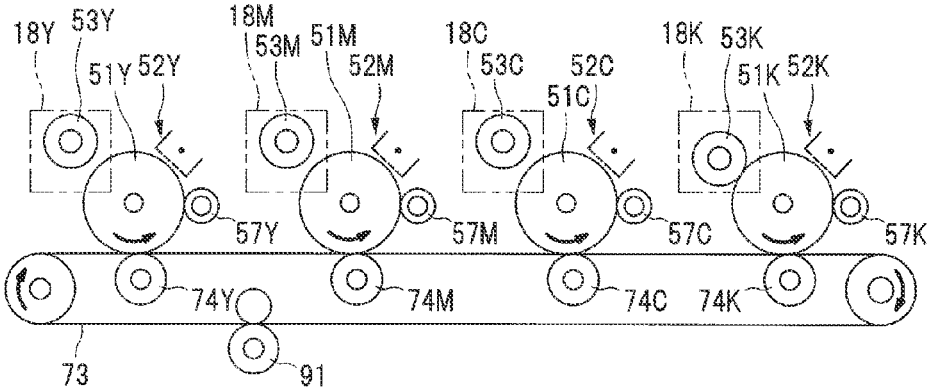
FIG. 6B is a view illustrating a state where only a developing roller for black is in contact with a corresponding photosensitive drum.
Figure 6C:
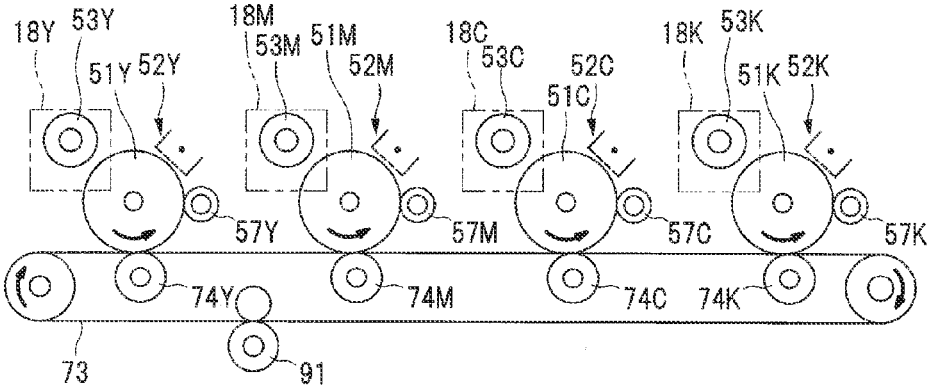
FIG. 6C is a view illustrating a state where all developing rollers are separated from the corresponding photosensitive drums.

A color printer 1 of the present exemplary embodiment includes not only a plurality of photosensitive drums 51, a plurality of holding rollers 57, a transfer unit 70, a collecting unit 90 and a control device 100 (see FIG. 1), but also four contact/separation mechanisms 18 provided corresponding to the individual developing rollers 53 as shown in FIGS. 6A to 6C.

The contact/separation mechanisms 18 are known mechanisms for bring the developing rollers 53 into contact with corresponding photosensitive drums 51 of the process units 50 or separating the developing rollers 53 from corresponding photosensitive drums 51. The operations of the contact/separation mechanisms 18 are controlled by the control device 100. When a color image forming operation is performed, the contact/separation mechanisms 18 bring all developing rollers 53 into contact with corresponding photosensitive drums 51 as shown in FIG. 6A. Further, when a monochrome image forming operation is performed, as shown in FIG. 6B, the contact/separation mechanisms 18 bring the developing roller 53K into contact with the photosensitive drum 51K, and separate the developing rollers 53Y, 53M and 53C from corresponding photosensitive drums 51Y, 51M and 51C. Further, when a cleaning operation is performed, as shown in FIG. 6C, the contact/separation mechanisms 18 separate all of the developing rollers 53 from corresponding photosensitive drums 51.

In a case where the control device 100 of the present exemplary embodiment recognizes existence of any image data after activation of the color printer 1 before a first image forming operation, if the recognized data is monochrome image data, the control device 100 controls the contact/separation mechanisms 18 to separate all of the developing rollers 53 from corresponding photosensitive drums 51 (see FIG. 6C), and performs a cleaning operation, specifically, a moving operation, a first collecting operation and a second collecting operation. Further, in the case where the control device 100 recognizes existence of any image data after activation of the color printer 1 before a first image forming operation, if the recognized data is color image data, the control device 100 controls the contact/separation mechanisms 18 to bring all of the developing rollers 53 into contact with corresponding photosensitive drums 51 (see FIG. 6A), and performs the cleaning operation while omitting the moving operation and the first collecting operation, that is, only the second collecting operation.

In a case of the monochrome image forming operation, since the developing rollers 53Y, 53M and 53C are separated from the photosensitive drums 51Y, 51M and 51C (see FIG. 6B), if the image forming operation is performed without performing the cleaning operation, there is a possibility that toner on the photosensitive drums 51Y, 51M and 51C might be attached to a sheet S or the conveyance belt 73. For this reason, in the present exemplary embodiment, in a case where the recognized data is monochrome image data, the moving operation, the first collecting operation and the second collecting operation are performed to clean the holding rollers 57, the photosensitive drums 51 and the conveyance belt 73, and then the image forming operation is performed. Therefore, it is possible to collect toner on the photosensitive drums 51Y, 51M and 51C well by the clean holding rollers 57, and thus it is possible to suppress a reduction in image quality.

On the other hand, in a case of the color image forming operation, since all photosensitive drums 51 come into contact with corresponding photosensitive drums 51 (see FIG. 6A), it is possible to collect toner on the photosensitive drums 51 by the developing rollers 53 being in contact with the photosensitive drums 51. Therefore, there may not cause a problem of attachment of toner on the photosensitive drums 51 to a sheet S or the conveyance belt 73. Therefore, in the present exemplary embodiment, in a case where the recognized data is color image data, only the second collecting operation is performed, whereby toner on the photosensitive drums 51 is mechanically collected by the developing rollers 53 while toner on the conveyance belt 73 is collected by the first collecting roller 91. In this case, the moving operation and the first collecting operation which are part of the cleaning operation are omitted. Therefore, it is possible to reduce the time of the cleaning operation. As a result, it is possible to improve the lifetime of the color printer 1, and to reduce the time for the color printer 1 to become capable of image forming.

Incidentally, in the present exemplary embodiment, in the case where the recognized data is color image data, the moving operation and the first collecting operation are omitted, and only the second collecting operation is performed. However, the present invention is not limited thereto. For example, the color printer 1 may be configured to omit only the moving operation and perform the collecting operation (both of the first collecting operation and the second collecting operation). Alternatively, the color printer 1 may be configured to omit both of the moving operation and the collecting operation in the case where the recognized data is color image data.

Although the exemplary embodiments of the present invention have been described above, the present invention is not limited to the above-described exemplary embodiments. The specific configurations can be appropriately modified within the scope of the present invention.

In the above-described exemplary embodiments, as a collecting member for collecting toner on the conveyance belt 73, a configuration including the first collecting roller 91, the second collecting roller 92 and the scraping blade 93 has been exemplified. However, the present invention is not limited thereto. For example, the collecting member may be composed of only a scraping blade. Further, in the above-described exemplary embodiments, toner is moved in order of the holding rollers 57, the photosensitive drums 51 and the conveyance belt 73, and is collected by the collecting unit 90. However, the present invention is not limited thereto. For example, referring to FIG. 1, instead of the holding rollers 57, scraping blades may be configured to come into contact with the photosensitive drums 51 and scrap toner on the photosensitive drums 51, thereby collecting the toner. Alternatively, the holding rollers 57 and the like may be omitted, and toner on the photosensitive drums 51 may be collected into the toner containers 56 through the developing rollers 53. Alternatively, for example, it may be configured such that toner on the conveyance belt 73 may be moved onto the photosensitive drums 51 and be collected by the holding rollers 57 or the like.

In the above-described exemplary embodiments, in the case where existence of any image data is recognized after activation before a first image forming operation, if the recognized data is patch image data, the second collecting operation is performed. However, the present invention is not limited thereto. For example, in the case where the recognized data is patch image data, prior to a patch image forming operation, both of the first collecting operation and the second collecting operation may be performed to clean all of the photosensitive drums 51 and the conveyance belt 73. According to this configuration, it is possible to suppress residual toner on the photosensitive drums 51 after transfer from being transferred together with a patch image onto the conveyance belt 73. Therefore, it is possible to further improve accuracy of correction. Alternatively, when the recognized data is patch image data, all of the moving operation, the first collecting operation and the second collecting operation may be performed.

Further, in the above-described exemplary embodiments, when the recognized data is data of a patch image, the second collecting operation is necessarily performed. However, the present invention is not limited thereto. For example, in a case where all of the above-described first to third flags are set, formation of the patch image on the conveyance belt 73 and correction based on the patch image may be performed without performing the cleaning operation. According to this configuration, it is possible to omit an unnecessary cleaning operation, and thus it becomes possible to improve the lifetime of the color printer 1.

The configuration of the image forming unit 30 shown in the above-described exemplary embodiments is an example, and the present invention is not limited to the above-described configuration. For example, in the above-described exemplary embodiments, as an endless belt which is disposed to face the photosensitive drums 51, the conveyance belt 73 has been exemplified. However, the present invention is not limited thereto. For example, the endless belt may be an intermediate transfer belt or the like. Further, in the above-described exemplary embodiments, as image carriers on which developer images are formed, the photosensitive drums 51 have been exemplified. However, the present invention is not limited thereto. For example, other image carriers such as a photosensitive belt, an intermediate transfer belt and an intermediate transfer drum may be used. Further, in the above-described exemplary embodiments, as holding members, the holding rollers 57 have been exemplified. However, the present invention is not limited thereto. For example, other holding members such as charging rollers may be used.

In the above-described exemplary embodiments, as an image forming apparatus, the color printer 1 including a plurality of image carriers and capable of both of color image formation and monochrome image formation has been exemplified. However, the present invention is not limited thereto. For example, the image forming apparatus may be a printer including one image carrier and capable of forming only a monochrome image. Further, the image forming apparatus is not limited to printers, but may be other apparatuses, such as a copy machine or a multi-function apparatus having a document reading unit such as flatbed scanner.

In the above-described exemplary embodiments, examples obtained by applying the present invention to an image forming apparatus using positive charge type developer have been disclosed. However, the present invention is not limited thereto. That is, the present invention can also be applied to an image forming operation using negative charge type developer. In this case, the positive and negative polarities of each bias become opposite to those of the above-described exemplary embodiments, and the magnitude of each bias becomes the magnitude of the absolute value of the corresponding bias.

What is claimed is:

1. An image forming apparatus configured to transfer a developer image onto a recording sheet to form an image, comprising:

an image forming unit configured to transfer the developer image;

a processor; and memory storing computer readable instructions that, when executed by the processor, causing the image forming apparatus to:

perform an image forming operation of forming the image;

perform a cleaning operation of cleaning unnecessary developer of the image forming unit;

in a case where existence of data of an image which is to be formed is recognized after activation of the image forming apparatus and before a first image forming operation, determine whether to perform the cleaning operation; and in a case where existence of data of the image which is to be formed is not recognized after the activation of the image forming apparatus and before the first image forming operation, not perform the cleaning operation.

2. The image forming apparatus according to claim 1, wherein the image forming unit comprises an image carrier configured to carry a developer image formed thereon, and wherein the cleaning operation includes a collecting operation of collecting unnecessary developer attached to the image carrier.

3. The image forming apparatus according to claim 2, wherein the image forming unit comprises a holding member configured to hold the unnecessary developer attached to the image carrier and to move the held unnecessary developer onto the image carrier, wherein the cleaning operation includes a moving operation of moving the unnecessary developer held by the holding member onto the image carrier, wherein the image forming apparatus is caused to:

perform the moving operation and the collecting operation after the image forming operation terminates;

set a flag when a predetermined time period elapses from a start of the moving operation; and unset the flag when the image forming operation starts, and wherein, in the case where the existence of data of the image which is to be formed is recognized after the activation of the image forming apparatus and before the first image forming operation, the image forming apparatus is caused to:

if the flag is not set, perform the moving operation and the collecting operation; and if the flag is set, omit performance of at least the moving operation.

4. The image forming apparatus according to claim 2, wherein the cleaning operation includes a moving operation of moving unnecessary developer onto the image carrier;

wherein the image forming unit comprises a plurality of image carriers, wherein the image forming operation includes:

a monochrome image forming operation of forming a monochrome image on the recording sheet; and a color image forming operation of forming a color image on the recording sheet, and wherein, in the case where the existence of data of the image which is to be formed is recognized after the activation of the image forming apparatus and before the first image forming operation, the image forming apparatus is caused to:

if the recognized data is monochrome image data, perform the moving operation and the collecting operation; and if the recognized data is color image data, omit performance of at least the moving operation.

5. The image forming apparatus according to claim 2, wherein the image forming unit comprises:

a plurality of image carriers; and an endless belt disposed to face the image carriers, and wherein the collecting operation includes:

a first collecting operation of moving the unnecessary developer attached to the image carriers onto the belt; and a second collecting operation of collecting the unnecessary developer attached to the belt.

6. The image forming apparatus according to claim 5, wherein the cleaning operation includes a moving operation of moving unnecessary developer onto the image carrier;

wherein the image forming operation includes:

a monochrome image forming operation of forming a monochrome image on the recording sheet; and a color image forming operation of forming a color image on the recording sheet, and wherein, in the case where the existence of data of the image which is to be formed is recognized after the activation of the image forming apparatus and before the first image forming operation, the image forming apparatus is caused to:

if the recognized data is monochrome image data, perform the moving operation and the collecting operation; and if the recognized data is color image data, omit performance of at least the moving operation and the first collecting operation.

7. The image forming apparatus according to claim 5, wherein the image forming operation includes a patch image forming operation of forming a patch image on the belt, and wherein, in the case where the existence of data of the image which is to be formed is recognized after the activation of the image forming apparatus and before the first image forming operation, the image forming apparatus is caused to:

if the recognized data is patch image data, perform at least the second collecting operation.

8. The image forming apparatus according to claim 5, wherein the cleaning operation includes a moving operation of moving unnecessary developer onto the image carrier, wherein the image forming apparatus is further caused to:

set a first flag when a first time period elapses from a start of the moving operation;

set a second flag when a second time period elapses from a start of the first collecting operation;

set a third flag when a third time period elapses from a start of the second collecting operation; and unset the first flag, the second flag and the third flag when the image forming operation starts, and wherein, in the case where the existence of data of the image which is to be formed is recognized after the activation of the image forming apparatus and before the first image forming operation, the image forming apparatus is caused to:

if the first flag is not set, perform the moving operation, the first collecting operation and the second collecting operation;

if the first flag is set and the second flag is not set, perform the first collecting operation and the second collecting operation while omitting performance of the moving operation; and if the first flag is set and the second flag is set, perform the second collecting operation while omitting performance of the moving operation and the first collecting operation.

* * * * *